US006523373B1

(12) United States Patent
Su

(10) Patent No.: US 6,523,373 B1
(45) Date of Patent: Feb. 25, 2003

(54) NOTEBOOK COMPUTER LOCK

(75) Inventor: Shun-Chang Su, Chang Hua Hsien (TW)

(73) Assignee: Tai Luer Industry Corp., Chang Hua Hsien (TW)

( * ) Notice: Subject to any disclaimer, the term of this patent is extended or adjusted under 35 U.S.C. 154(b) by 0 days.

(21) Appl. No.: 10/086,281

(22) Filed: Mar. 4, 2002

(51) Int. Cl.[7] ..... E05B 69/00; E05B 73/00

(52) U.S. Cl. ..... 70/58; 70/28; 70/312; 70/425; 70/426

(58) Field of Search ..... 70/58, 57.1, 14, 70/18, 23, 29, 30, 49, 27, 28, 312, 425, 426

(56) References Cited

U.S. PATENT DOCUMENTS 4,610,152 A * 9/1986 Duringer ..... 70/30
5,560,232 A * 10/1996 Chen ..... 70/30
6,058,744 A * 5/2000 Ling ..... 70/28
6,305,197 B1 * 10/2001 Ling ..... 70/30
6,305,199 B1 * 10/2001 Igelmund ..... 70/58
6,327,752 B1 * 12/2001 Hinkey ..... 24/115 M
6,401,502 B1 * 6/2002 Yang ..... 70/30
6,449,992 B1 * 9/2002 Yu et al. ..... 70/58
6,463,770 B1 * 10/2002 Lee ..... 70/58
6,470,718 B1 * 10/2002 Yang ..... 70/30

* cited by examiner

*Primary Examiner*—John B. Walsh
(74) *Attorney, Agent, or Firm*—Harrison & Egbert

(57) ABSTRACT

A lock is designed to prevent theft of a notebook computer and is formed of a housing, a metal fastening, a locking mechanism, and a retaining mechanism. The locking mechanism includes an arresting bolt with a conical tip and a dial block. The retaining mechanism includes a retaining bolt with an inclined surface, which is pushed by the conical tip of the arresting bolt such that a hooked end of the retaining bolt is engaged with a T-shaped slot of the notebook computer at such time when the wheels of the locking mechanism are turned randomly. When the wheels of the locking mechanism are turned to a set series of numbers, the conical tip of the arresting bolt moves away from the inclined surface of the retaining bolt, thereby resulting in disengagement of the hooked end of the retaining bolt with the T-shaped slot of the notebook computer.

2 Claims, 9 Drawing Sheets

NOTEBOOK COMPUTER LOCK

RELATED U.S. APPLICATIONS

Not applicable.

STATEMENT REGARDING FEDERALLY SPONSORED

RESEARCH OR DEVELOPMENT

Not applicable.

REFERENCE TO MICROFICHE APPENDIX

Not applicable.

FIELD OF THE INVENTION

The present invention relates generally to a lock, and more particularly to a theftproof lock of notebook computer.

BACKGROUND OF THE INVENTION

The notebook computer is portable and is widely used in place of desktop computer. In light of the notebook computer being a handy and helpful personal adjunct for people from all walks of life, the notebook computer is vulnerable to theft. The theft of the notebook computer can often result in a serious deprivation of the owner of the notebook computer due to loss of important data which are kept in the notebook computer.

BRIEF SUMMARY OF THE INVENTION

The primary objective of the present invention is to provide a notebook computer lock to prevent the theft of the notebook computer.

In keeping with the principle of the present invention, the foregoing objective of the present invention is attained by a notebook computer lock comprising a housing, a locking mechanism, a retaining mechanism, and a metal fastening. The locking mechanism comprises an arresting bolt to which the retaining mechanism is connected such that the retaining mechanism is controlled by the locking mechanism to engage or disengage the notebook computer. The housing is provided with a connector to which the metal fastening is connected. The notebook computer can be thus fastened to a fixed object by the metal fastening.

The features and the advantages of the present invention will be more readily understood upon a thoughtful deliberation of the following detailed description of the present invention with reference to the accompanying drawings.

DETAILED DESCRIPTION OF THE INVENTION

Figure 1:
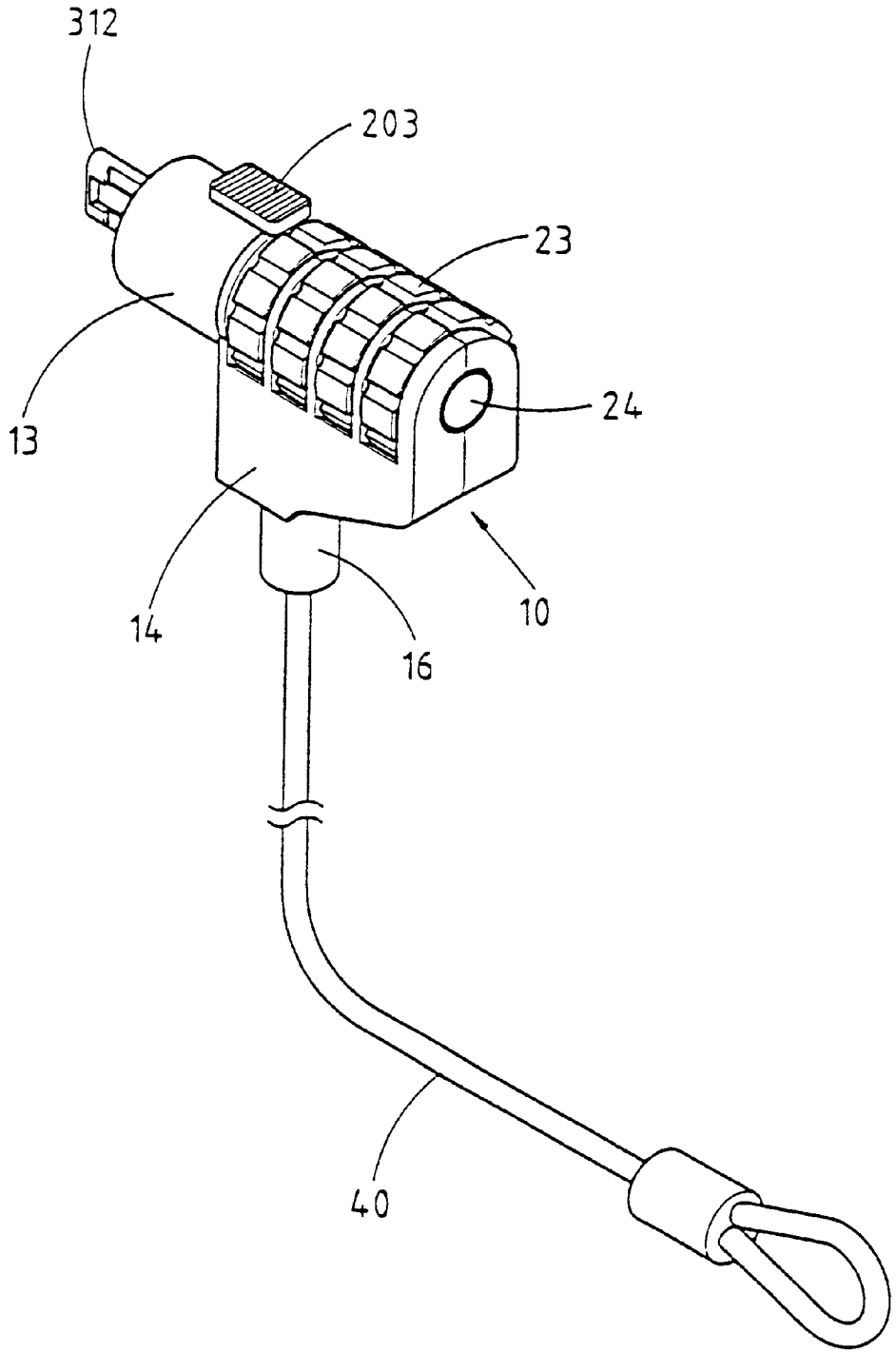
FIG. 1 shows a perspective view of the present invention.
Figure 2:
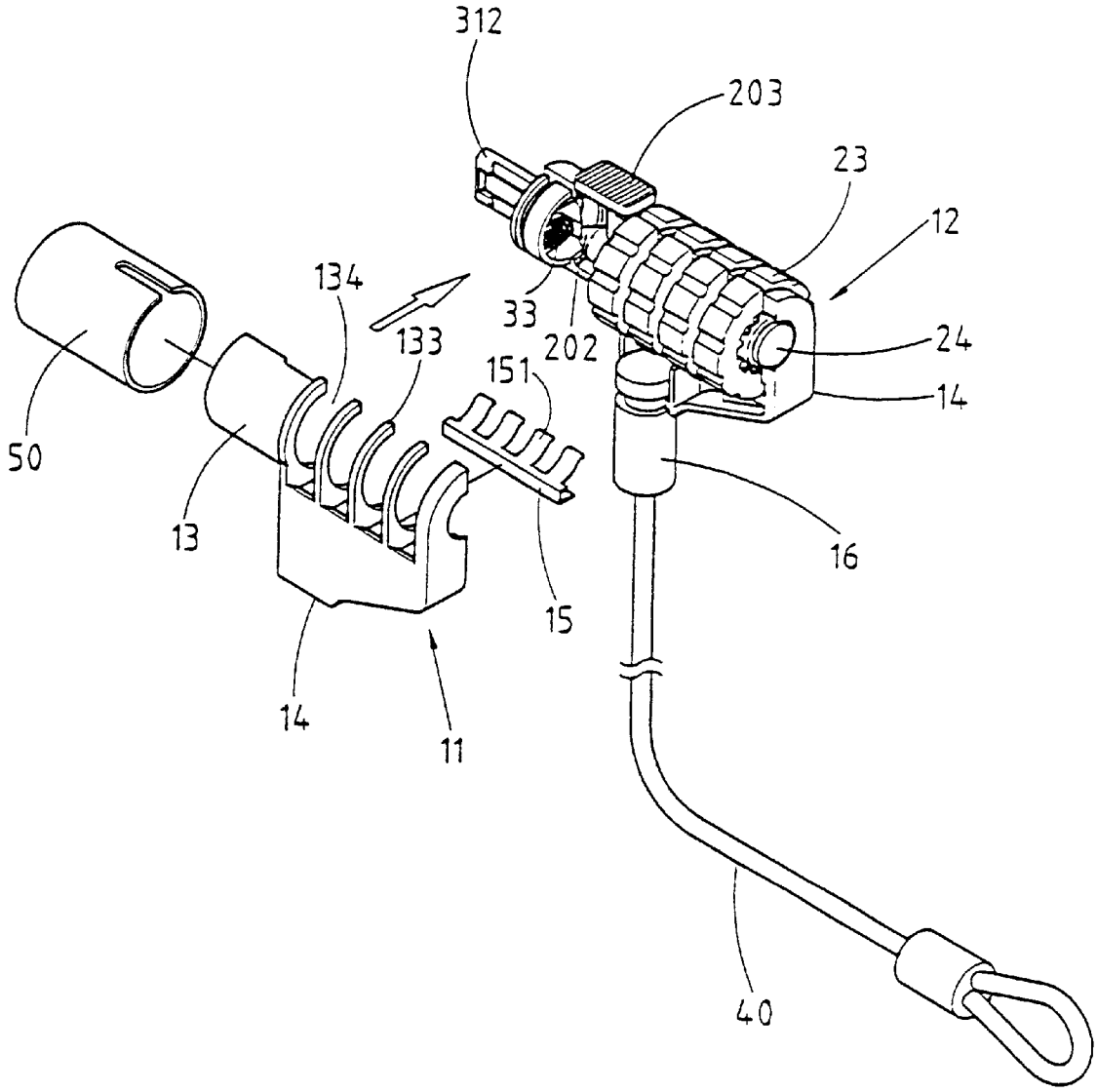
FIG. 2 shows a partial exploded perspective view of the present invention.
Figure 3:
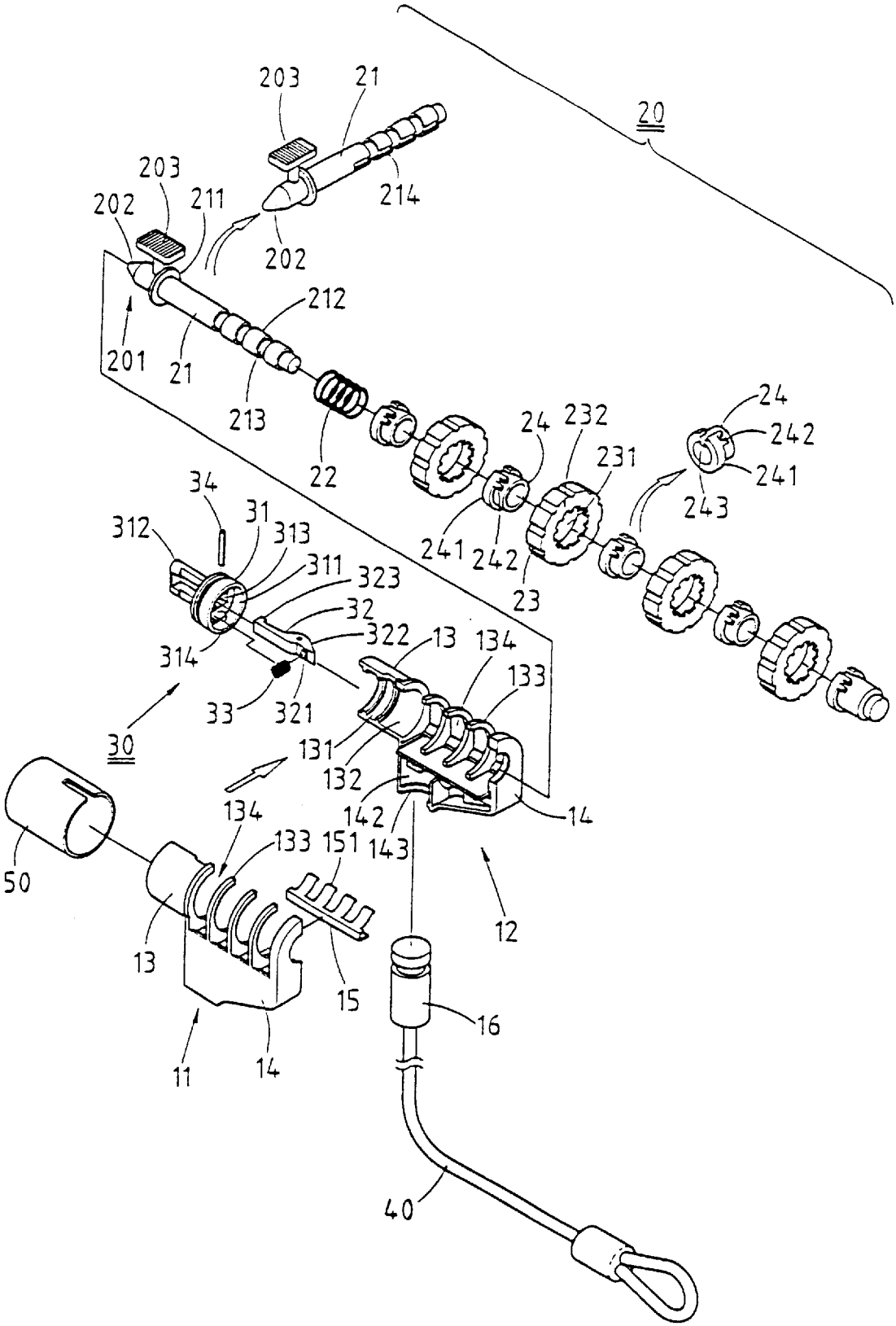
FIG. 3 shows a complete exploded perspective view of the present invention.

As shown in FIGS. 1–5, a notebook computer lock embodied in the present invention comprises a housing 10, a locking mechanism 20, a retaining mechanism 30, and a metal fastening 40.

The housing 10 is formed of a first piece 11, a second piece 12, a front tubular seat 13 formed jointly by the first piece 11 and the second piece 12, and a rear seat 14 formed jointly by the first piece 11 and the second piece 12. The front tubular seat 13 is provided in the inner wall with the first annular groove 131 and a second annular groove 132. Located between the front tubular seat 13 and the rear seat 14 are a plurality of open spaces 134 which are separated by a plurality of annular ribs 133. The rear base 14 is provided with an elastic piece 15 having a plurality of projecting pieces 151, which are located in the open spaces 134. The rear base 14 is further provided in the bottom wall with a tubular slot 142, which is provided in the inner wall with an arresting ring 143 for retaining a connector 16 to which one end of the metal fastening 40 is fastened.

The locking mechanism 20 is formed of an arresting bolt 21, a spring 22, a plurality of numbered or lettered wheels 23, and a plurality of position-controlling pieces 24. The arresting bolt 21 has a front end 201 which is provided with a stop ring 211. The arresting bolt 21 has a rear end which is provided with a plurality of raised portions 212 and recessed portions 213. The arresting bolt 21 is provided in the longitudinal direction with a long slot 214 extending through the raised portions 212 and the recessed portions 213. The spring 22 is fitted over the rear end of the arresting bolt 21 such that one end of the spring 22 is stopped by the stop ring 211. The numbered or lettered wheels 23 are provided with a center hole 231 which is provided in the inner wall with a plurality of retaining grooves 232. The position-controlling pieces 24 are provided with an annular edge 241 which is in turn provided with a plurality of retaining projections 242. The position-controlling pieces 24 are provided in the inner wall with a protruded block 243. The position-controlling pieces 24 are respectively fitted into the center hole 231 of the wheels 23 such that the retaining projections 242 are retained in the retaining grooves 232 of the center hole 231, thereby enabling the numbered or lettered wheels 23 in motion to actuate the position-controlling pieces 24 to turn. The protruded block 243 of the position-controlling pieces 24 is aligned with a specific number or letter of the wheel 23. The arresting bolt 21 is put through the position-controlling pieces 24 by aligning the long slot 214 of the arresting bolt 21 with the protruded blocks 243 of the position-controlling pieces 24. The arresting bolt 21 and the numbered or lettered wheels 23 are received in the interior of the tubular seat 13 of the housing 10 such that the wheels 23 and the position-controlling pieces 24 are located in the open spaces 134, and that the protruded blocks 243 of the position-controlling pieces 24 are located in the recessed portions 213 of the arresting bolt 21. The spring 22 is stopped at other end by one of the wheels 23. The projecting pieces 151 of the elastic piece 15 are in contact with the rims of the wheels 23. The front end 201 of the arresting bolt 21 is located in the second annular groove 132 of the tubular seat 13.

The locking mechanism 20 is characterized by the arresting bolt 21 which is provided at the front end 201 thereof with a conical tip 202, and a dial block 203 which juts out of the tubular seat 13 of the housing 10.

Figure 4:
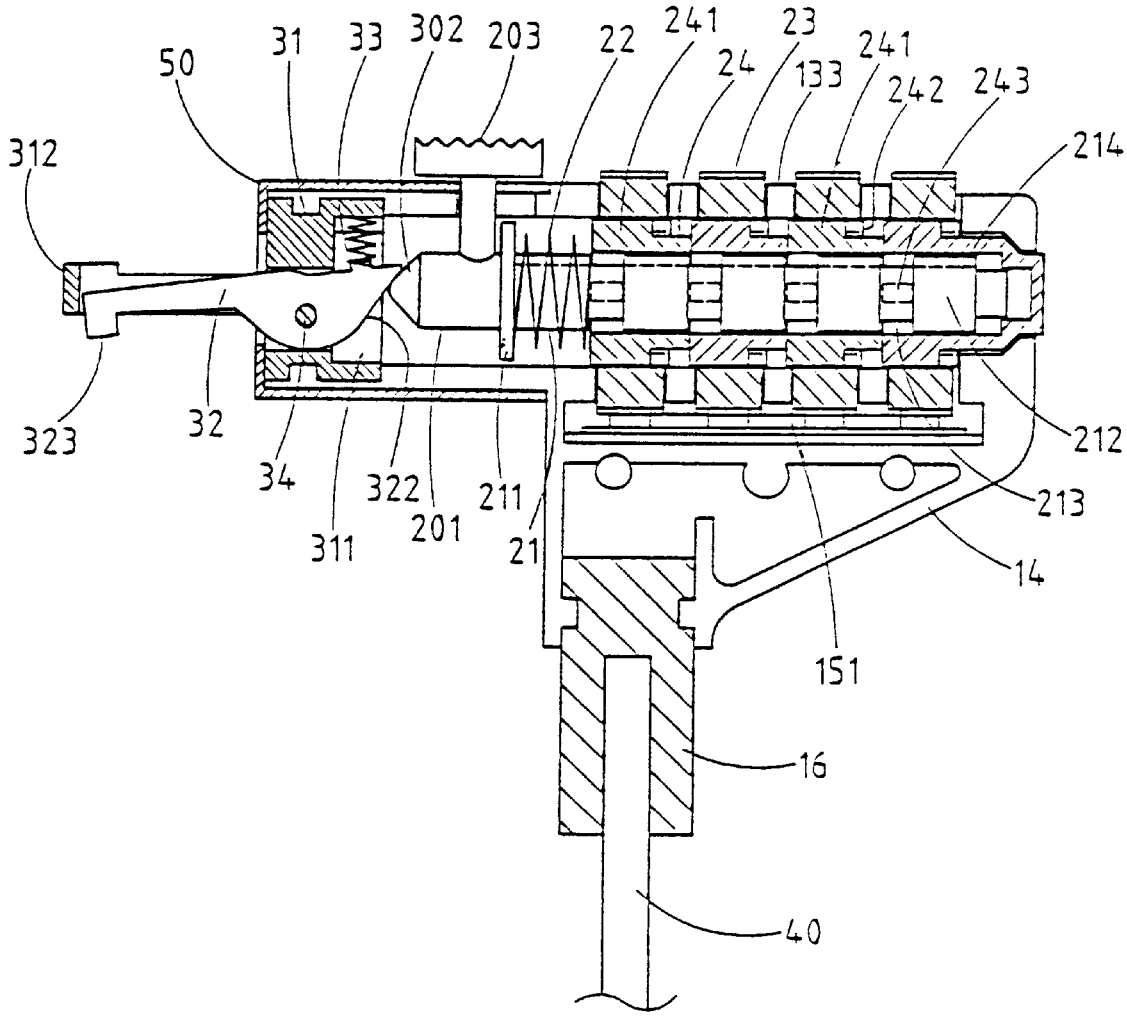
FIG. 4 shows a longitudinal sectional view of the present invention in the locking state.
Figure 5:
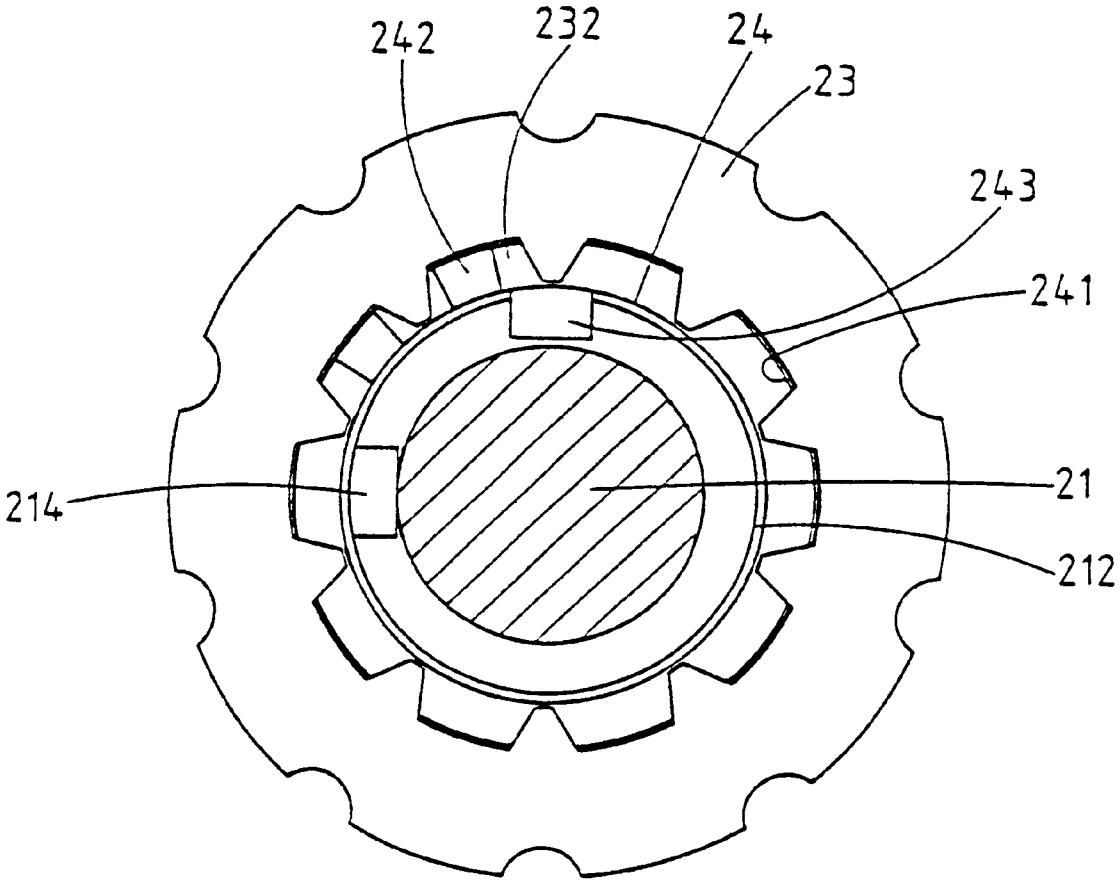
FIG. 5 shows a cross-sectional view of the present invention in the locking state.

In addition, the front tubular seat 13 of the housing 10 is characterized by its first annular groove 131 to which the retaining mechanism 30 is pivotally fastened. The retaining mechanism 30 is formed of a locating tube 31, a retaining bolt 32, and a spring 33. The locating tube 31 is pivoted to the first annular groove 131 and is provided in the rear end with a slot 311, in the front end with a retaining frame 312. The locating tube 31 is provided with a through hole 313 extending through the front end and the rear end thereof. The retaining bolt 32 is disposed in the through hole 313 in conjunction with a pin 34 for pivoting the retaining bolt 32. The retaining bolt 32 is provided at the rear end with a projection 321 for retaining one end of the spring 33, with other end of the spring 33 being received in the slot 311 of the locating tube 31. The retaining bolt 32 is provided with an inclined surface 322. The retaining bolt 32 is provided at the front end with an inverted hook 323. The conical tip 202 of the arresting bolt 21 is urged by the spring 22 to press against the inclined surface 322 of the retaining bolt 32, as shown in FIG. 4. As a result, the hook 323 is caught in a T-shaped slot 2 of a notebook computer 1. As the numbered or lettered wheels 23 are randomly turned, the protruded blocks 243 of the position-controlling pieces 24 are not aligned with the long slot 214 of the arresting bolt 21, as shown in FIG. 5, the arresting bolt 21 can not be retracted at the time when the dial block 203 is exerted on by an external force, because of the raised portions 212 of the arresting bolt 21 being arrested by the protruded blocks 243 of the position-controlling pieces 24.

Figure 7:
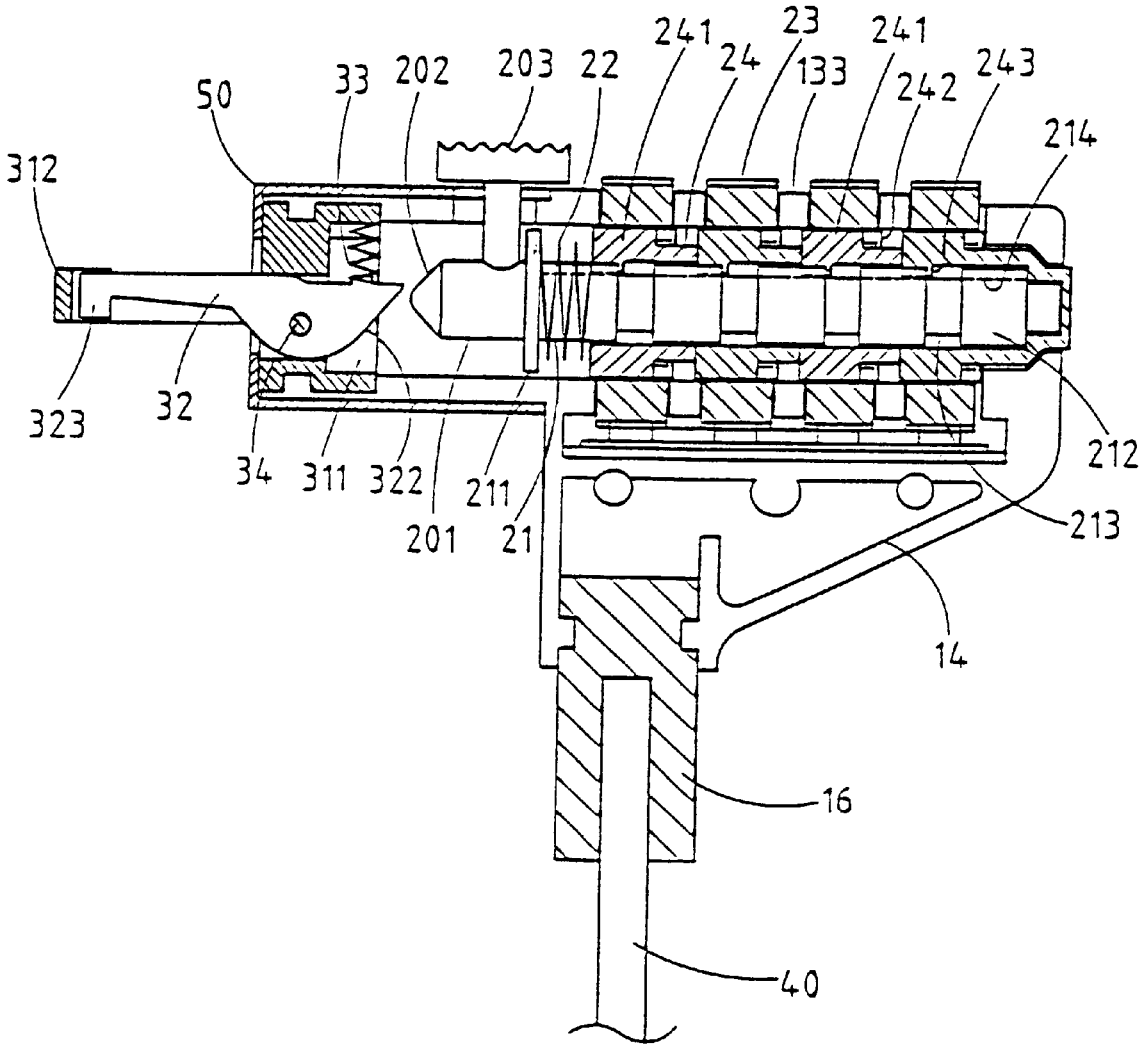
FIG. 7 shows a longitudinal sectional view of the present invention in the unlocking state.
Figure 8:
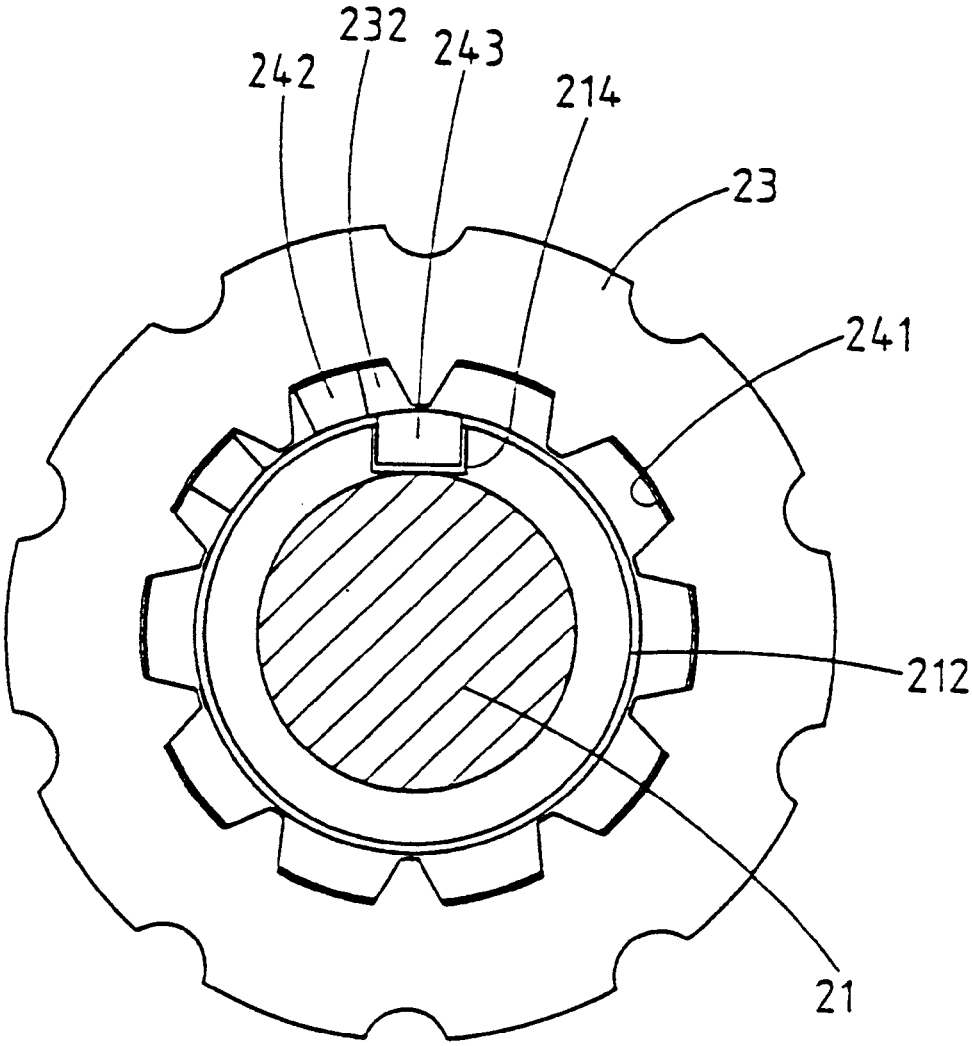
FIG. 8 shows a cross-sectional view of the present invention in the unlocking state.
Figure 9:
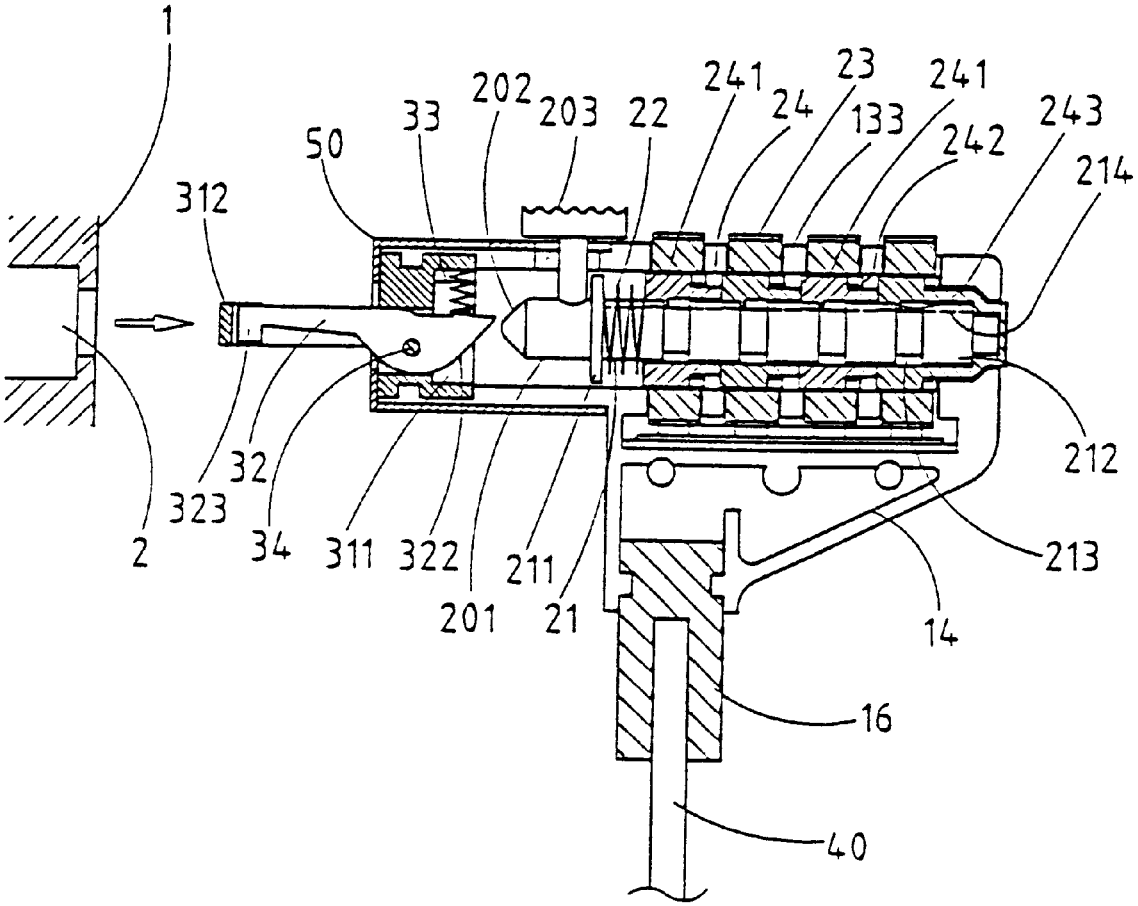
FIG. 9 shows a sectional schematic view of the present invention being disengaged with a notebook computer.

The notebook computer lock is unlocked by turning the wheels 23 to a set series of numbers or letters, thereby resulting in alignment of the long slot 214 of the arresting bolt 21 and the protruded blocks 243 of the position-controlling pieces 24, as shown in FIG. 8. Thereafter, the dial block 203 is moved backward to cause the arresting bolt 21 to retract without being obstructed. As a result, the conical tip 202 of the front end 201 of the arresting bolt 21 moves away from the inclined surface 322 of the retaining bolt 32 of the retaining mechanism 30, as shown in FIG. 7. In the meantime, the retaining bolt 32 is urged by the spring 33 such that the hook 323 of the front end of the retaining bolt 32 moves into the retaining frame 312, thereby enabling the retaining frame 312 to be pulled out of the T-shaped slot 2 of the notebook computer 1, as shown in FIG. 9.

Figure 6:
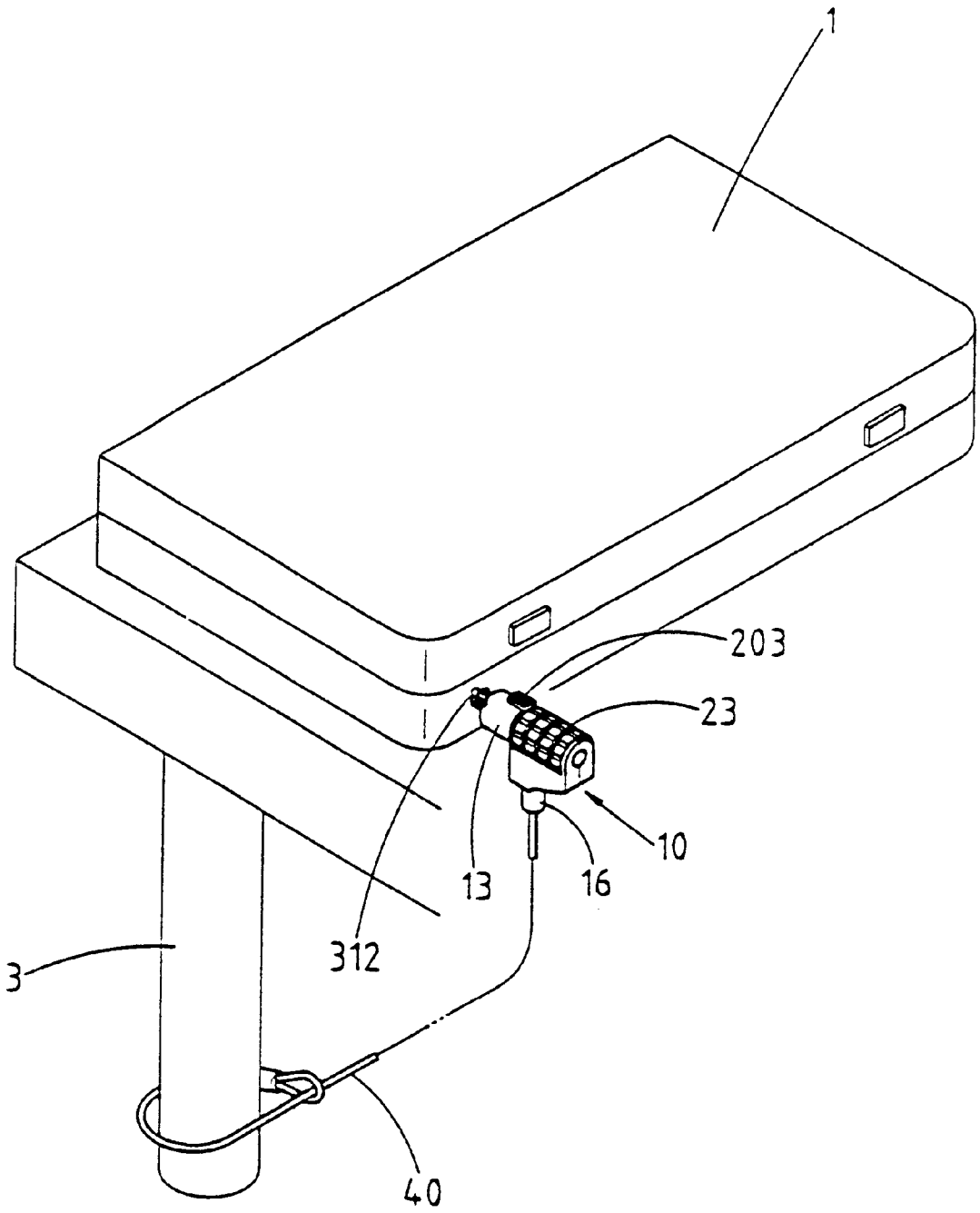
FIG. 6 shows a perspective view of the present invention at work.

As shown in FIG. 6, the notebook computer 1 is fastened to a fixed object 3 by the metal fastening 40 of the present invention.

The front tubular seat 13 of the housing 10 is provided with a protective sleeve 50 fastened therewith. The protective sleeve 50 is intended to prevent the locking mechanism 20 and the retaining mechanism 30 from being tampered with.

The present invention described above is to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A lock for preventing theft of a notebook computer which is comprised of a T-shaped slot cooperative with said lock, said lock comprising:

a housing which is comprised of a front tubular seat, a rear seat, and a plurality of open spaces located between said front tubular seat and said rear seat, said front tubular seat being provided in an inner wall with a first annular groove and a second annular groove, said housing being further comprised of an elastic piece having a plurality of projecting pieces;

a metal fastening which is fastened at one end to housing;

a locking mechanism comprised of an arresting bolt, a plurality of numbered or lettered wheels and position-controlling pieces equal in number to said wheels, said position-controlling pieces being fitted respectively into a center hole of said wheels such that said position-controlling pieces turn along with said wheel, said position-controlling pieces and said wheels being rotatably mounted on said arresting bolt in conjunction with a spring which is fitted over said arresting bolt such that one end of said spring is stopped by a stop ring of a front end of said arresting bolt, and such that another end of said spring is stopped by one of said wheels, said arresting bolt being comprised of, in an outer surface, a plurality of raised portions, recessed portions, and a longitudinal slot extending through said raised portions and said recessed portions, said position-controlling pieces being provided in an inner wall with a protruded block corresponding in location to said longitudinal slot of said arresting bolt at such time when said wheels are turned to a set series of numbers or letters; and a retaining mechanism fastened to said front tubular seat of said housing and comprised of a locating tube, a retaining bolt, and a spring, said locating tube being provided at a front end with a retaining frame, said retaining bolt being provided at a front end with a hook and at a rear end with a projection, said retaining bolt being pivoted in said locating tube in conjunction with said spring such that one end of said spring is retained by said projection of said retaining bolt and such that another end of said spring is located in a slot of said locating tube, said hook of said retaining bolt being actuated by said arresting bolt of said locking mechanism to move out of said retaining frame of said locating tube to engage the T-shaped slot of the notebook computer at the time when said wheels of said locking mechanism are randomly turned such that said protruded blocks of said position-controlling pieces are not aligned with said longitudinal slot of said arresting bolt, said protruded blocks of said position-controlling pieces being aligned with said longitudinal slot of said arresting bolt at such time when said wheels are turned to a set series of numbers or letters, thereby resulting in disengagement of said locking mechanism with said retaining mechanism so as to cause said hook of said retaining bolt of said retaining mechanism to move into said retaining frame of said locating tube of said retaining mechanism to result in disengagement of said hook with the T-shaped slot of the notebook computer;

wherein said arresting bolt of said locking mechanism is comprised of, at the front end, a conical tip and a dial block extending out of said housing;

wherein said retaining bolt of said retaining mechanism is provided at the rear end with an inclined surface opposite in location to said projection of the rear end of said retaining bolt whereby said inclined surface of said retaining bolt is pushed by said conical tip of the front end of said arresting bolt at the time when said wheels are randomly turned to cause said protruded blocks of said position-controlling pieces to be nonaligned with said longitudinal slot of said arresting bolt, thereby causing said hook of the front end of said retaining bolt to move out of said retaining frame of said locating tube to engage the T-shaped slot of the notebook computer whereby said hook of said retaining bolt is actuated to move into said retaining frame by a spring force of said spring urging the rear end of said retaining bolt at the time when said wheels are turned to a set series of numbers or letters to bring about alignment of said protruded blocks of said position-controlling pieces with said longitudinal slot of said arresting bolt, so as to enable said arresting bolt to be moved by said dial block of the front end of said arresting bolt such that said conical tip of the front end of said arresting bolt is moved away from said inclined surface of the rear end of said retaining bolt.

2. The lock as defined in claim 1 further comprising a protective sleeve whereby said protective sleeve is fastened with said front tubular seat of said housing to prevent said locking mechanism and said retaining mechanism from being tampered with.

* * * * *